US006216760B1

(12) United States Patent
D'Aguiar

(10) Patent No.: US 6,216,760 B1
(45) Date of Patent: Apr. 17, 2001

(54) ADJUSTABLE IN-PLATE GLUING SYSTEM

(76) Inventor: Raymond D'Aguiar, 150 W. Providencia Ave., Burbank, CA (US) 91502

( * ) Notice: Subject to any disclaimer, the term of this patent is extended or adjusted under 35 U.S.C. 154(b) by 0 days.

(21) Appl. No.: 09/332,276

(22) Filed: Jun. 12, 1999

(51) Int. Cl.[7] ..... B32B 31/00
(52) U.S. Cl. ..... 156/363; 156/575; 156/578
(58) Field of Search ..... 156/64, 362, 363, 156/364, 575, 578, 580

(56) References Cited

U.S. PATENT DOCUMENTS 5,098,508 * 3/1992 Mattil ..... 156/363
5,228,946 * 7/1993 Draudt ..... 156/580
5,264,069 * 11/1993 Dietrich et al. ..... 156/559
5,477,901 * 12/1995 Schikarski et al. ..... 156/498

* cited by examiner

*Primary Examiner*—James Sells

(57) ABSTRACT

An adjustable in-plate gluing system for adjustable and detachable use with a conventional buckle plate for folding machines. The buckle plate has a front, a rear, two sides, and a number of spanners spanning the buckle plate. The in-plate gluing system includes hot glue applicator unit and a photoelectric eye unit. The hot glue applicator unit has a rod support bracket for adjustable attachment to the rear of the buckle plate, a rod for attachment to rod support bracket, a hot glue applicator bracket for adjustable attachment to the rod, and a hot glue applicator adapted for attachment to the hot glue applicator bracket. The photoelectric eye unit has a photoelectric eye bracket for adjustable attachment to the buckle plate and a photoelectric eye attached to photoelectric eye bracket.

5 Claims, 5 Drawing Sheets

ADJUSTABLE IN-PLATE GLUING SYSTEM

BACKGROUND OF THE INVENTION

1. Field of the Invention

This invention relates to the field of systems for applying glue, and more particularly to an in-plate hot glue application system for folding machines, which in-plate hot glue application system can be quickly fitted onto any number of folding racks for folding machines and easily adjusted to accommodate a desired hot glue application, even for relatively short folding and glue runs.

2. Description of the Prior Art

A tremendous volume of printed material is generated and distributed around the world. Much of this printed material comprises sheet material such as printed paper which is folded and which can also be detachably retained in a closed position so that it may be mailed and otherwise handled without inadvertently opening up. For small folding jobs, or for very complicated folding projects, hand folding is often employed. For large volume runs of folded materials, folding machines are used when practical.

These folding machines include folding plates or buckle plates, wherein each buckle plate is used to create a single fold in a sheet of material. For example, tri-fold materials are folded using folding machines with two racks. There are several means to retain folded material in a closed position. These means include use of staples, paper and plastic stickers, tear strips, and adhesives, just to name a few. Quick release adhesives have gained popularity for use in detachably holding together folded printed material in a closed position.

These quick release adhesives typically comprise hot melt glues which are applied in a heated form and which cool quickly, yet retain elasticity. In their best form, once applied, these hot melt adhesives hold the folded material together well, yet allow the folded pages to be easily peeled apart without damaging the printed material. These hot melt adhesives typically are clear or transparent.

The hot glue applicators typically use either an electric or pneumatic applicator, which dispenses the desired quantity of hot glue to the material to be adhered together. Manufacturers of such hot glue dispensers include Robatech, of Switzerland, and the Slautterback Corporation of Monterey, California, among others.

Generally, after the printed material is folded, the folded printed material is sent to a different machine to apply the hot melt adhesive. However, it is desirable to simplify the manufacturing process (by eliminating steps) and minimize the need for expensive equipment to the greatest extent possible. The inventor herein is familiar with in-plate gluing systems in which electric adhesive applicators are fixed to a moveable sheet stop of a buckle plate. In such in-plate gluing system, however, since the adhesive applicators are fixed in position to the movable sheet stop of the buckle plate, the position of the adhesive applicators relative to the front of the movable sheet stop and the side to side position of the adhesive applicators within the rack is also not readily adjustable once positioned.

Since there is no simple means to provide for adjustability of the adhesive applicators on buckle plates of such in-plate gluing system, it is relatively time consuming to set up buckle plates with adhesive applicators. As a result, buckle plates tend to become set up and dedicated for particular runs. Another issue is cost. Adhesive applicators, the photoelectric eyes used therewith, and the various heated glue hoses and other parts are relatively costly. It would therefore be desirable to have an in-plate gluing system that can be set up easily and quickly, and which can be swapped out to other buckle plates to obviate the need to purchase separate in-plate gluing systems for the sets of buckle plates for each fold and glue job.

SUMMARY OF THE INVENTION

One object of the present invention is to provide an easy to fit and fully adjustable in-plate hot glue application system for use with folding machines.

Another object of the invention is to provide an in-plate hot glue application system which uses a series of slideable brackets and rods to allow the system to be quickly yet securely attached to conventional folding plates for desired folding runs on a folding machine, then reused for printing runs with different requirements, including use on different buckle plates.

These and other aspects of the invention are met by providing an adjustable in-plate gluing system for adjustable and detachable use with a buckle plate for a folding machine, the buckle plate having a front, a rear, two sides, and a plurality of spanners spanning the buckle plate, the in-plate gluing system comprising:

- a rod support bracket means for adjustable attachment to the rear of the buckle plate;
- a rod for attachment to rod support bracket means;
- a hot glue applicator bracket means for adjustable attachment to the rod;
- a hot glue applicator attached to the hot glue applicator bracket means;
- a photoelectric eye bracket for adjustable attachment to the buckle plate; and
- a photoelectric eye attached to photoelectric eye bracket.

These and other objects of the invention are set forth below.

DESCRIPTION OF THE PREFERRED EMBODIMENT

Figure 1:
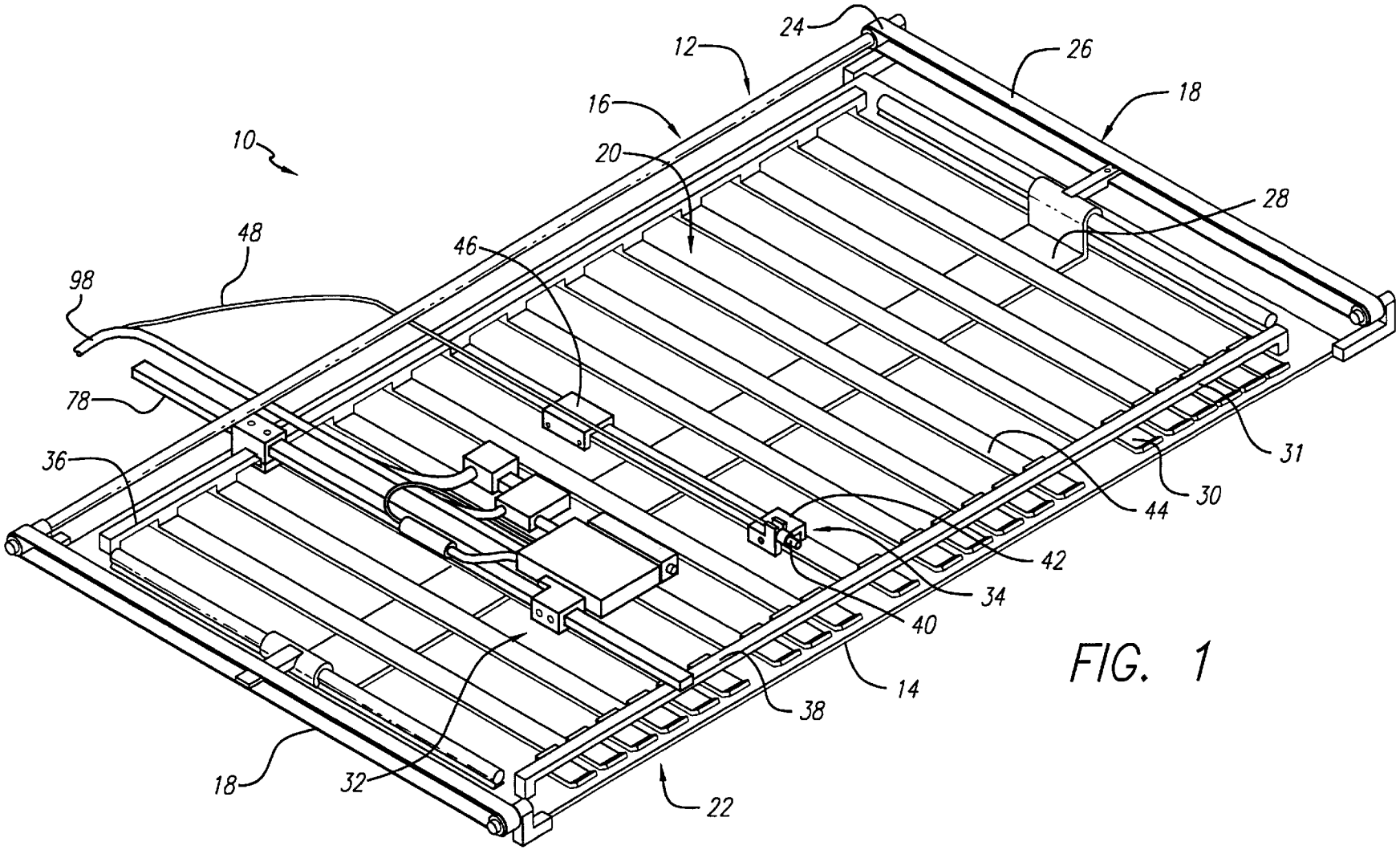
FIG. 1 is a perspective view of a first embodiment of an in-plate gluing system of the invention attached to a buckle plate for a folding machine.

Referring to FIG. 1, a perspective view of a first embodiment of an in-plate gluing system 10 generally designated, is shown mounted to a buckle plate or folding plate 12 for use with a folding machine (not shown.) The buckle plate 12 can be conventional in design and has a front 14, a rear 16, sides 18, a top face 20, and a bottom face 22. A number of spanners 44 extend from the front to rear 14, 16 of buckle plate 12. Located along the sides 18 is a drive means 24 with drive belt 26. Drive belt 26 attaches to a moveable sheet stop 28 to allow sheet stop 28 to be moved between the front and rear 14 and 16, respectively, of buckle plate 12.

The position of sheet stop 28 determines how far a sheet of material to be folded will slide into buckle plate 12 before it contacts sheet stop 28 and is folded. Located at front 14 of buckle rack 12 are series of feet 30. These feet 30 can be either fixed in a stationary position, or can be made to be adjustable from side to side in a feet support rail 31, so that the feet 30 do not ride on glue after it is applied to the sheet material, and the sheet material is withdrawn from buckle rack 12.

In-plate gluing system 10 provides a system to allow hot glue applicator units 32 and photoelectric eye units 34 to be adjusted from side-to-side and from front to rear on conventional buckle plates 12, independent of the position of sheet stop 28. In FIG. 1, a single hot glue applicator unit 32 and a single photoelectric eye unit 34 are shown, but it is understood that a plurality of hot glue applicator units 32 and photoelectric eye units 34 can be used on a single buckle rack 12 to accommodate the need to apply multiple points or lines of adhesives to sheet material. Located along the rear 16 of buckle rack 12 is a section of tubing 36. A section of tubing 38 is likewise located along front 14 of buckle rack 12. Sections of tubing 36 and 38 are preferably rectangular in cross section.

Figure 3:
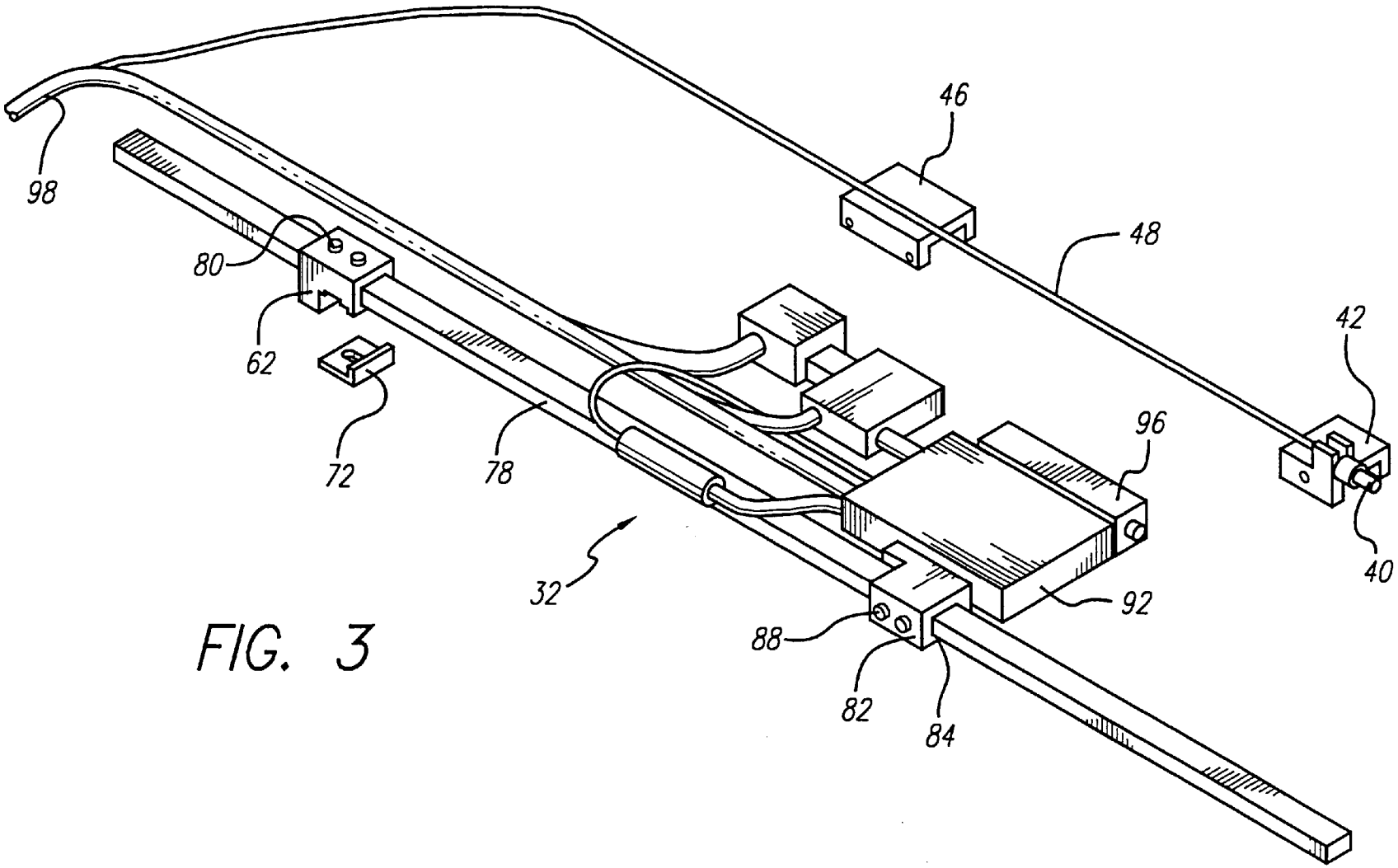
FIG. 3 is a perspective view of a portion of the first embodiment of the in-plate gluing system.
Figure 5:
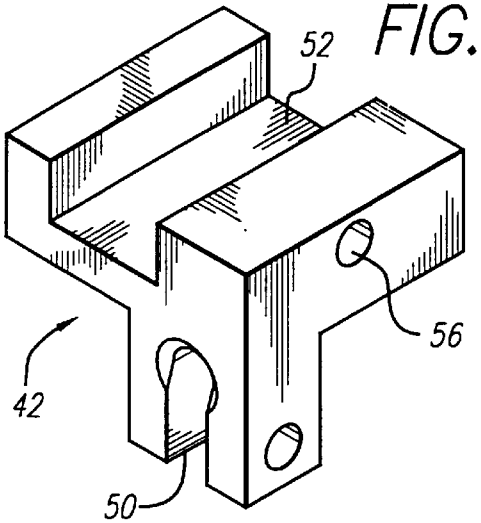
FIG. 5 is a perspective view of the photoelectric eye bracket.

Referring to FIGS. 3 and 5, photoelectric eye unit 34 has a photoelectric eye 40 and a photoelectric eye bracket 42 which is adapted to be mounted to one of a series of spanners 44 that extend between the front 14 and rear 16 of buckle plate 12, as shown in FIG. 1. A photoelectric eye cable support bracket 46 of FIG. 3 is likewise attached to a spanner 44 to support photoelectric eye cable 48.

Photoelectric eye 40 works in conjunction with hot glue applicator unit 32 to detect the presence or absence of sheet material, so that hot glue applicator unit can be properly timed to dispense the hot glue at the appropriate intervals (for example, either when the paper has stopped moving for spot applications, or when the sheet material is still moving, for application of lines of hot glue).

Figure 4:
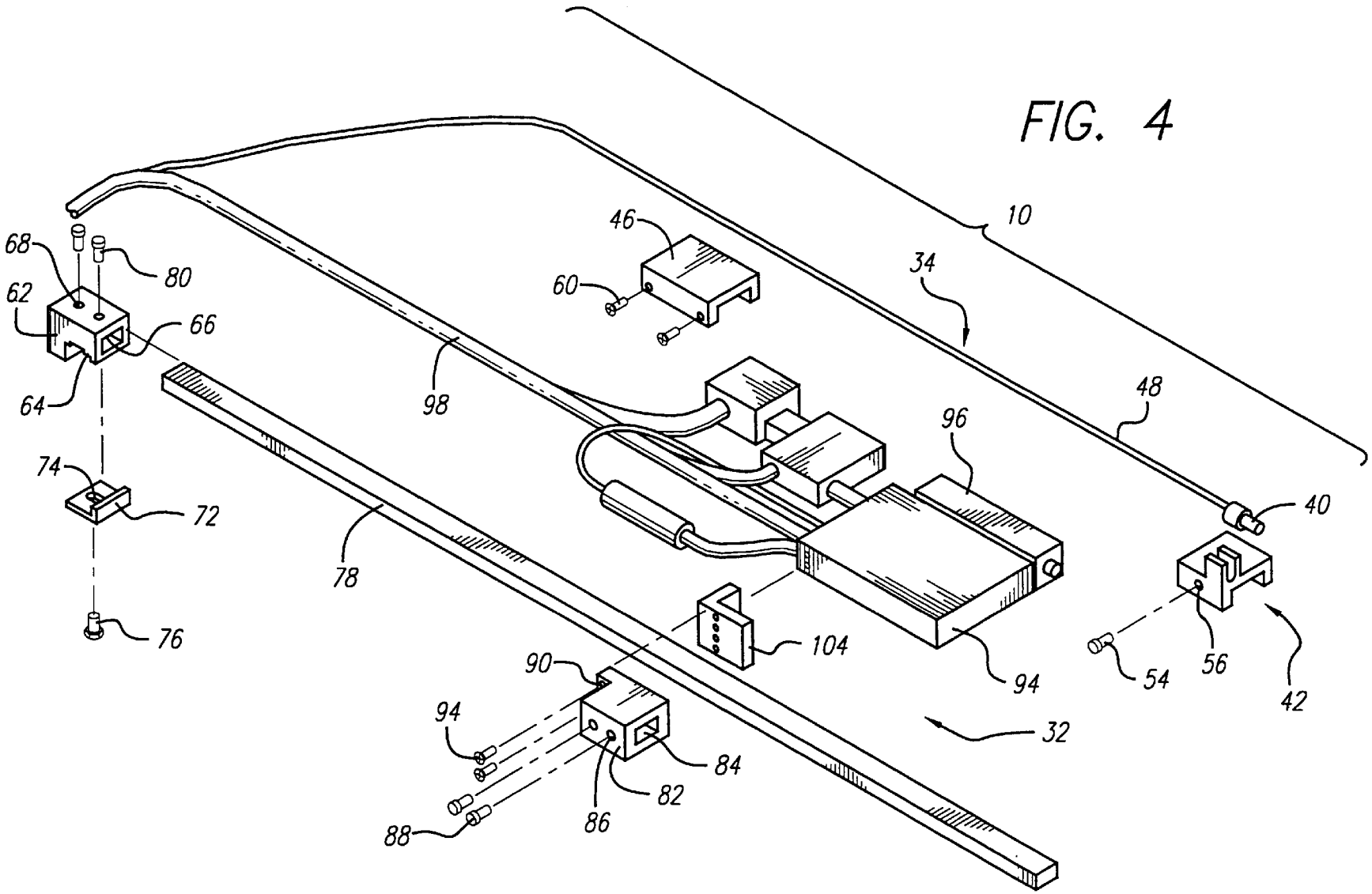
FIG. 4 is an exploded view of a portion of the second embodiment of the in-plate gluing system.

Turning to FIG. 5, a perspective view of photoelectric eye bracket 42 is shown, and has a grip portion 50 for holding photoelectric eye (not shown) and a plate runner contact portion 52. A bolt 54 (as shown in FIG. 4) can be threaded through aperture 56 to adjustably support photoelectric eye bracket 42 on a spanner 44 at a desired position on buckle plate 12. Allen bolts or other types of bolts can be used to securely, yet detachably hold support photoelectric eye bracket 42 securely in place.

Figure 6:
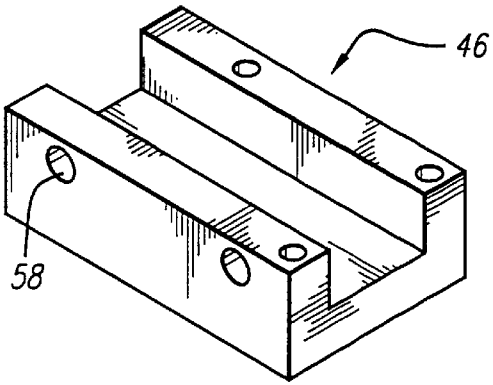
FIG. 6 is a perspective view of the photoelectric eye cable support bracket.

As shown in FIG. 6, photoelectric eye cable support bracket 46 is shown. It preferably has threaded apertures 58 through which bolts 60 (as shown in FIG. 4) can be threaded to support photoelectric eye cable support bracket 46 on spanner 44.

Figure 7:
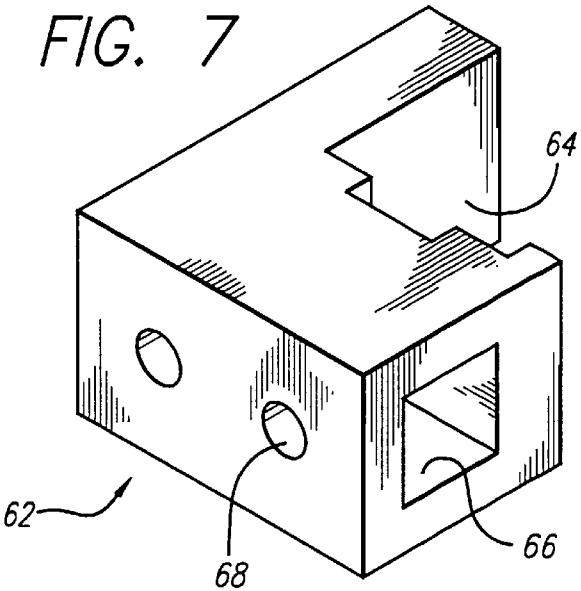
FIG. 7 is a perspective view of the rod support bracket.

Referring to FIGS. 3 and 4, the hot glue applicator unit 32 is shown attached above top face 20 of buckle plate 12. Referring to FIGS. 3, 4 and 7, hot glue applicator unit 32 includes rod support bracket 62 which has clamp end 64 adapted to fix snugly onto tubing 36 at rear of buckle rack 10 (as shown in FIG. 1.) A rod aperture 66 of FIG. 7 is formed through rack engagement bracket 62. Preferably, rod aperture 66 is not circular in cross-section and rod 78 will have a complementary cross-section so that rod 78 will be slideably in aperture 66 but will not be able to spin or twist in aperture 66.

Figure 8:
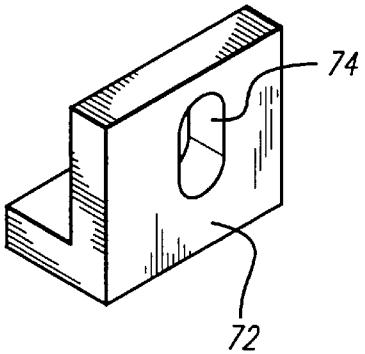
FIG. 8 is a perspective view of the rod support bracket backing plate.

Bolt holes 68 are formed in rack engagement bracket 58 and receive bolts 70, as shown in FIG. 4. A rod support bracket plate 72 of FIGS. 3, 4 and 8 preferably has a slot aperture 74 formed therethrough, through which a bolt 76 can be passed through to screw into rod support bracket 62. This will allow rod support bracket plate 72 to be quickly and securely bolted to a desired position on rear tubing 36 of buckle rack 12.

As shown in FIGS. 1, 3, and 4, a rod 78 is sized to slidingly pass through rod aperture 66 in rod support bracket plate 72. Bolts 80 are threaded into bolt holes 68 to retain the desired position of rod 78 in rod aperture 66 of rod support bracket plate 72.

Other means can be used to slideably, yet securely attach rod 78 to rack engagement bracket 62. As shown in FIG. 1, a front end of rod 78 will rest on front tubing 38 of buckle rack 12, and rod 78 will be thusly stabilized. Obviously, the side-to-side position of rod support bracket 62 on buckle rack 12 can be easily adjusted by loosening bolt 76 and sliding rod support bracket 62 on tubing 36 at rear of buckle rack 12.

Figure 9:
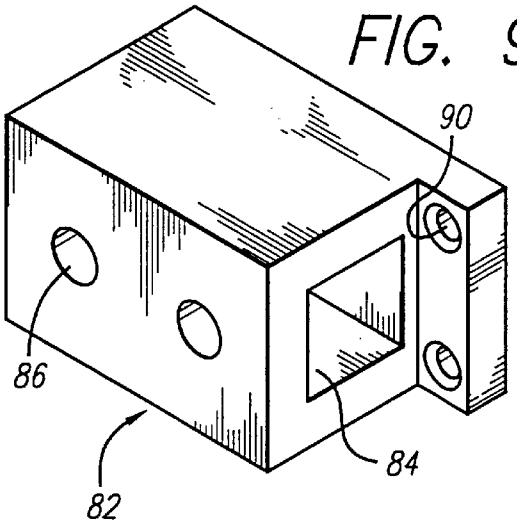
FIG. 9 is a perspective view of the hot glue unit support bracket.

Referring now to FIGS. 3, 4, and 9, hot glue applicator bracket 82 has an aperture 84 sized to receive rod 78. Bolt holes 86 are formed in hot glue applicator bracket 82 and are adapted to receive bolts 88 to lock the position of hot glue applicator bracket 82 on rod 78 at a desired position. This position can be changed easily. Hot glue applicator bracket 82 likewise has holes 90 for use in attaching hot glue applicator bracket 82 to hot glue valve 92 with bolts 94. In turn, hot glue valve 92 is attached to hot glue applicator nozzle 96.

Use of a pneumatic valve 92 allows a wider range of viscosities of hot glue to be used, although electric valves can also be used. It is through hot glue applicator nozzle 96 that hot glue will be sprayed downwardly onto sheet material to be folded and adhered together which passes near bottom face 22 of buckle plate 12. Hot glue supply hose 98 supplies hot glue to hot glue valve 92. For pneumatic valves, air pressure is used to activate the hot glue valve 92, and for electric valves, electricity is used to activate the valve.

Figure 2:
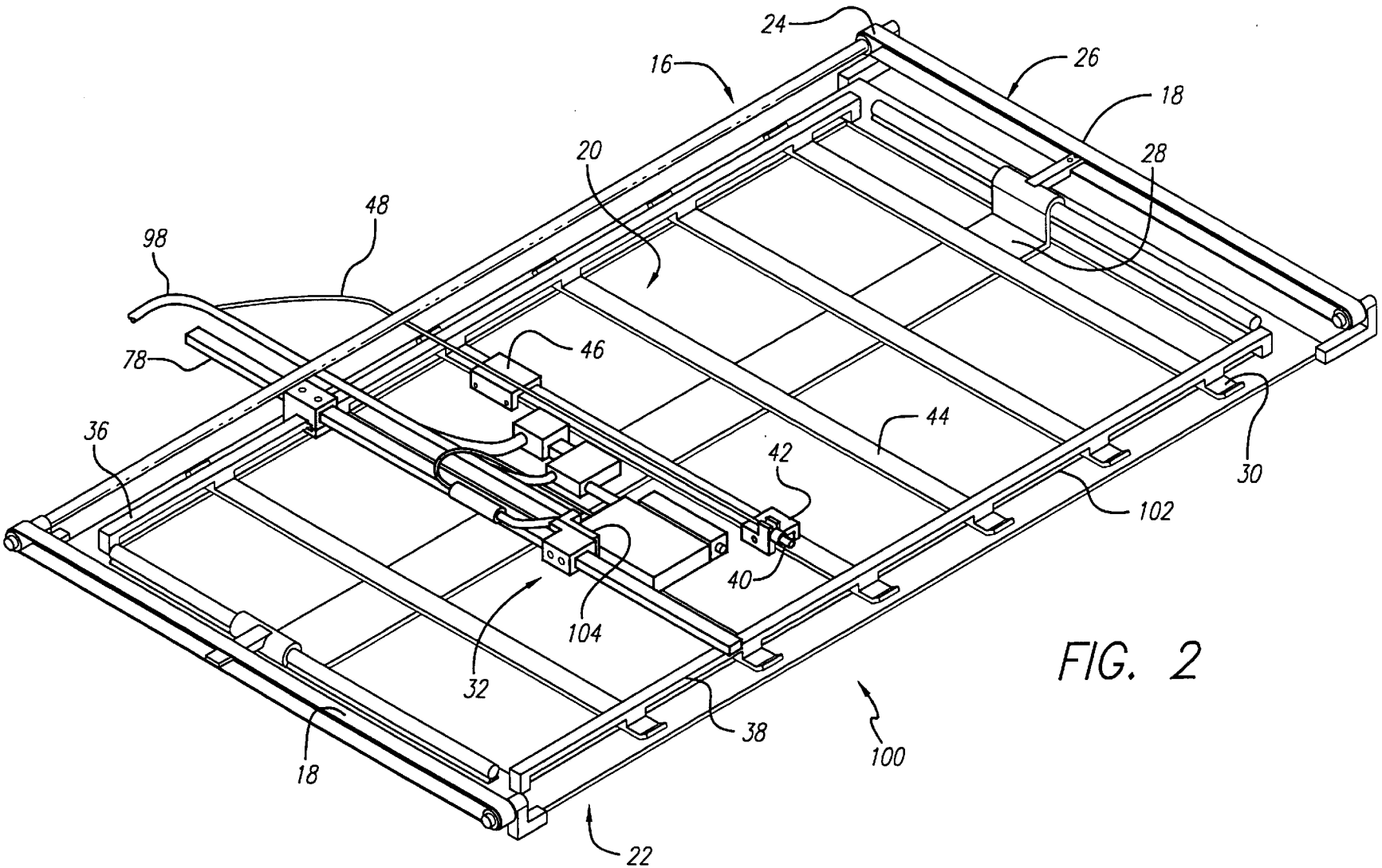
FIG. 2 is a perspective view of a second embodiment of an in-plate gluing system of the invention attached to a buckle plate for a folding machine.
Figure 10:
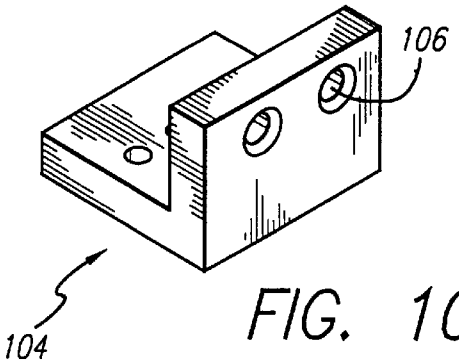
FIG. 10 is a perspective view of the extension bracket for the hot glue unit support bracket.

FIGS. 2 and 4 show a second embodiment of the in-plate gluing system 100 of the invention. This second embodiment 100 is almost identical to that of the first embodiment 10 and the same reference numerals identify the same parts and have the same features. Referring to FIGS. 4 and 10, however, an extension bracket 104, with alignment holes 106, is used to extend hot glue valve 92 and hot glue applicator nozzle 94 downwardly to be closer to sheet material to which hot glue will be applied. This second embodiment 100 is useful in cases where the buckle plate 102 is thick and/or it is desirable to position hot glue valve 92 and hot glue nozzle 96 closer to the sheet material that would be possible without use of an extension bracket 104.

The various brackets and parts of the system can be conveniently formed of high strength material such as steel, aluminum, or other materials. While the two above described embodiments of the invention make reference to use of bolts to hold the various brackets, rods and units together, other known detachable detachment means can be used as well.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation, the scope of the invention being delineated in the claims that follow.

I claim:

1. An adjustable in-plate gluing system for adjustable and detachable use with a buckle plate for a folding machine, the buckle plate having a front, a rear, two sides, and a plurality of spanners spanning the buckle plate, the in-plate gluing system comprising:

a rod support bracket means for adjustable attachment to the rear of the buckle plate;

a rod for attachment to rod support bracket means;

a hot glue applicator bracket means for adjustable attachment to the rod; a hot glue applicator attached to the hot glue applicator bracket means;

a photoelectric eye bracket for adjustable attachment to the buckle plate; and a photoelectric eye attached to photoelectric eye bracket.

2. The adjustable in-plate gluing system of claim 1, wherein the photoelectric eye bracket comprises a body portion with plate runner contact portion, at least one threaded aperture, and a bolt to secure body portion to a plate runner, and further comprising a photoelectric eye cable support bracket to secure a cable for the photoelectric eye in place.

3. The adjustable in-plate gluing system of claim 1, wherein the rod support bracket means comprises a clamp end which fits snugly onto the rear of the buckle plate, a rod support bracket plate and bolt for use in tightly bolting the rod support bracket means to the rear of the buckle plate once a desired position has been selected, an aperture formed in rod support bracket means which is sized to slidingly receive the rod, and a bolt to secure the rod in the aperture once a desired position of aperture is selected.

4. The adjustable in-plate gluing system of claim 1, further comprising an extension bracket for attachment between the hot glue applicator bracket means and the hot glue applicator to lower hot glue applicator relative to hot glue applicator bracket means.

5. The adjustable in-plate gluing system of claim 3, wherein rod has a rectangular cross section.

* * * * *